US006579250B2

(12) United States Patent
Robbins, III et al.

(10) Patent No.: US 6,579,250 B2
(45) Date of Patent: Jun. 17, 2003

(54) CHAIRMAT WITH FOOT MASSAGE AREA

(75) Inventors: Edward S. Robbins, III, 2802 E. Avalon Ave., Muscle Shoals, AL (US) 35662; Bobby Keith Rhodes, Florence, AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 101 days.

(21) Appl. No.: 09/853,781

(22) Filed: May 14, 2001

(65) Prior Publication Data

US 2002/0099313 A1 Jul. 25, 2002

Related U.S. Application Data

(63) Continuation-in-part of application No. 09/765,391, filed on Jan. 22, 2001.

(51) Int. Cl.[7] ..... A61H 7/00

(52) U.S. Cl. ..... 601/28; 601/136; 601/138; 428/120

(58) Field of Search ..... 601/22, 28, 104, 601/138, 136; 428/101, 102; 4/622; D24/212, 213

(56) References Cited

U.S. PATENT DOCUMENTS

| | | | | | |
|---|---|---|---|---|---|
| 1,931,146 | A | | 10/1933 | Hampel | |
| 1,981,379 | A | | 11/1934 | Thomson et al. | |
| 2,465,725 | A | | 3/1949 | Herzmark | |
| 2,476,921 | A | | 7/1949 | Shock | |
| 2,820,454 | A | | 1/1958 | Wright | |
| 3,100,483 | A | * | 8/1963 | Altmeyer et al. | 601/28 |
| 3,434,715 | A | | 3/1969 | Brantingham et al. | |
| 3,885,555 | A | | 5/1975 | Nobbs | |
| 4,003,372 | A | | 1/1977 | Willoby | |
| 4,329,981 | A | | 5/1982 | Dungl | |
| 4,435,451 | A | | 3/1984 | Neubert | |
| 4,509,510 | A | | 4/1985 | Hook | |
| 4,715,743 | A | | 12/1987 | Schmanski | |
| 4,784,888 | A | | 11/1988 | Schwertner et al. | |
| 4,813,405 | A | | 3/1989 | Filip | |
| 4,936,294 | A | | 6/1990 | Chu | |
| 5,096,188 | A | * | 3/1992 | Shen | 482/51 |
| 5,158,073 | A | | 10/1992 | Bukowski | |
| 5,186,703 | A | | 2/1993 | Huang | |
| 5,254,384 | A | * | 10/1993 | Gordon | 428/71 |
| 5,293,660 | A | * | 3/1994 | Park | 15/160 |
| 5,490,821 | A | | 2/1996 | Wu | |
| 5,575,034 | A | | 11/1996 | Biernacinski et al. | |
| 5,588,161 | A | * | 12/1996 | Barradas | 4/662 |
| 5,628,079 | A | | 5/1997 | Kizemchuk et al. | |
| 5,735,804 | A | | 4/1998 | Chan | |
| 5,830,163 | A | | 11/1998 | Obermaier | |
| 6,162,522 | A | * | 12/2000 | Deka et al. | 428/99 |
| 6,171,269 | B1 | | 1/2001 | Norin | |
| 6,177,165 | B1 | | 1/2001 | Robbins, III et al. | |
| 6,183,833 | B1 | | 2/2001 | Robbins, III et al. | |

* cited by examiner

*Primary Examiner*—Danton D. DeMille
(74) *Attorney, Agent, or Firm*—Nixon & Vanderhye P.C.

(57) ABSTRACT

A desk chairmat includes a substantially planar member having an upper surface, a lower surface, and a peripheral edge; the planar member having at least one foot massage area in a selected part thereof; and a foot massage panel secured within the selected area, the foot massage insert having a base and a plurality of upwardly projecting foot massage nodules. The foot massage panel may also be in the form of a peel and stick pad that is adhesively secured to the upper surface of the desk chairmat.

26 Claims, 7 Drawing Sheets

CHAIRMAT WITH FOOT MASSAGE AREA

This application is a continuation-in-part of co-pending application Ser. No. 09/765,391 filed Jan. 22, 2001.

BACKGROUND OF THE INVENTION

Desk chairmats are well known in the art and typically include a substantially planar member of generally square, rectangular or other shape, with or without a lip extension portion adapted to be located in the well area of a desk. Typical chairmats for use on carpeted floors also include a plurality of spikes or cleats projecting from the lower surface of the chairmat that anchor the chairmat and prevent drifting.

Foot massage mats are also known in the art, typically including mats of rubber or plastic construction, with an array of protuberances covering substantially the entire upper surface of the mat. Examples may be found in U.S. Pat. Nos. 5,575,034; 5,158,073; and 4,329,981.

This invention advantageously combines a desk chairmat with a foot massage mat to permit persons sitting at a desk to massage the soles of the feet in, for example, an office or home office environment.

In one exemplary embodiment, the invention provides a desk chairmat that includes a planar member with four side edges and a lip extension projecting from the forward edge of the mat. The lip extension is formed with a recess, and a plurality of hard, therapeutic nodules or protuberances projecting upwardly from the base of the recess, such that the protuberances or nodules do not extend substantially above the upper surface of the remainder of the chairmat. The nodules or protuberances are preferably of part-spherical shape but may have other shapes as well.

The chairmat is preferably of unitary construction, and is preferably made of a transparent or semi-transparent PVC, polypropylene, polycarbonate, or other suitable material.

In another arrangement, one or more massage inserts may be glued or heat sealed within cavities or recesses provided in the chairmat.

Another arrangement within the scope of the invention includes stick-on massage mats that consumers can attach to existing chairmats in order to add the foot massage feature.

It should be understood that the shape of the chairmat is not limited to square or rectangular and may include round, oval or other shapes. Moreover, the foot massage area may be included in an extended lip portion of the chairmat, or in a selected area within an otherwise regular peripheral border or edge of a chairmat of any shape.

In another embodiment, the foot massage area is located in an integrally hinged forward lip portion that can be pivoted upwardly about the hinge to an angled position relative to the remainder of the mat. A heater and/or massage vibrator device may be placed behind the lip portion to support the latter in its angled position and to enhance the massage feature.

In still another embodiment, resilient support for the hinged lip portion is provided by an integral extension of the mat itself that may be folded under the lip portion.

Accordingly, in its broader aspects, the invention relates to a desk chairmat comprising a substantially planar member having an upper surface, a lower surface, and a peripheral edge; the planar member having at least one recess in a selected are thereof; and a foot massage insert secured within the recess, the foot massage insert having a base and a plurality of upwardly projecting foot massage nodules.

In another aspect, the present invention relates to a desk chairmat comprising a substantially planar member having an upper surface, a lower surface, and a peripheral edge; and at lest one stick-on foot massage pad adhered to a selected area of the upper surface, the foot massage pad comprising a thin base and a plurality of upwardly projecting nodules thereon.

In another aspect, the invention relates to a foot massage pad comprising a thin carrier layer or base having a thickness of about 0.010 to 0.075 in.; a lower surface coated with a self-stick adhesive and a peel-away paper layer applied over the adhesive; and an upper surface having a plurality of upwardly projecting foot massage nodules thereon.

In still another aspect, the invention relates to a desk chairmat comprising a substantially planar member having an upper surface, a lower surface and a peripheral edge defined by four side edges and a forward lip portion extending away from one of the four side edges, the upper surface of the forward lip portion formed with a plurality of upwardly extending foot massage nodules, and wherein the forward lip portion is connected to the one of the four side edges by an integral hinge enabling the forward lip portion to be pivoted upwardly, out of the plane of the planar member to an angled foot massage position.

Other objects and advantages of the invention will become apparent from the detailed description that follows in connection with the drawings as briefly described below.

DETAILED DESCRIPTION OF THE INVENTION

Figure 1:
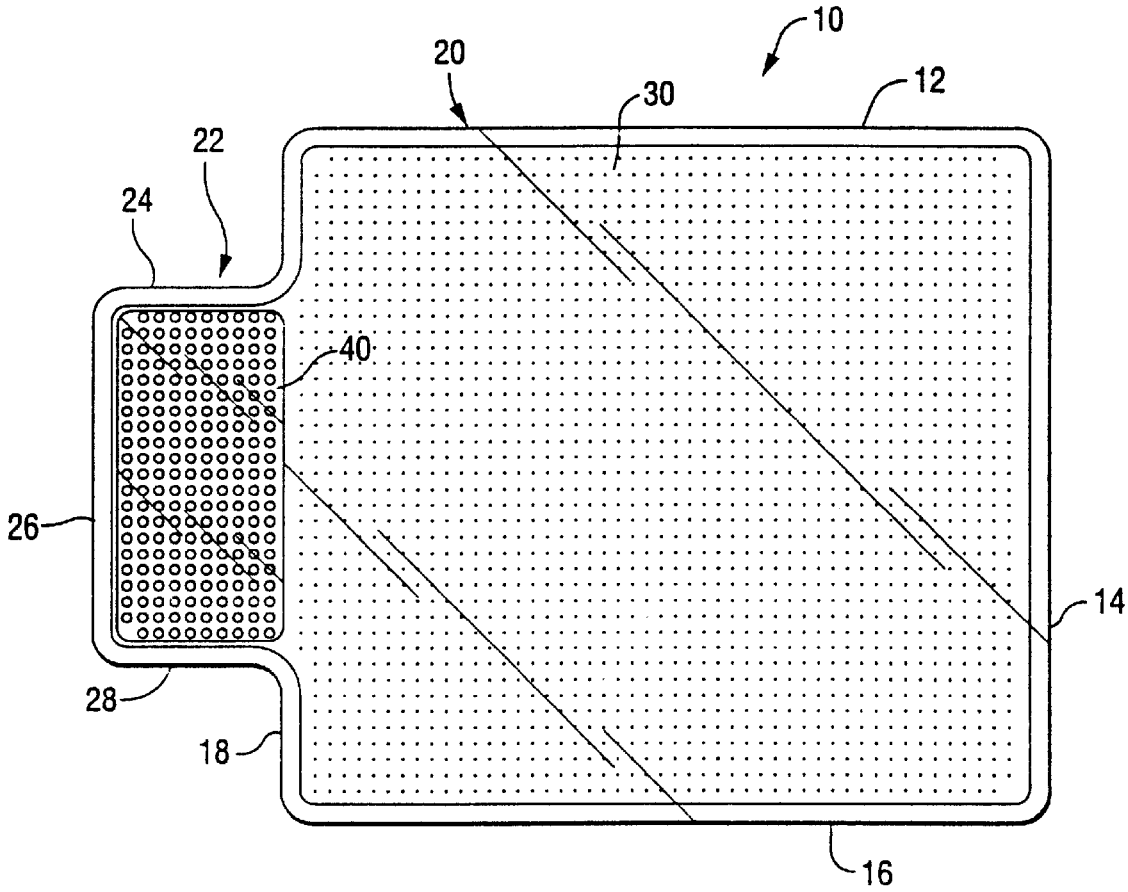
FIG. 1 is a plan view of a desk chairmat in accordance with an exemplary embodiment of the invention.

With reference to FIG. 1, a desk chairmat 10 in accordance with one exemplary embodiment includes a planar member having four side edges 12, 14, 16 and 18 which define a major portion 20 of the chairmat. A lip extension 22 of the same material and thickness, projects or extends integrally from the side edge 12 and is further defined by edges 24, 26 and 28. The lip extension 22, as is well known, is designed to project into the well area of a desk, with the remainder of the chairmat behind the desk and serving as the principal contact area for a desk chair (not shown) typically fitted with rollers or casters. The upper surface 30 of the chairmat is generally smooth, while the lower surface 32 is formed with a substantial number of relatively short but relatively sharp spikes or cleats 34 which are used to anchor the chairmat to an underlying carpet. As is also well understood in the art, chairmats for use on hard flooring do not require such spikes or cleats.

In accordance with this invention, the lip extension area 22 is formed with a generally rectangular recess 36 including a flat base surface 38 surrounded by a beveled edge or wall 40 having rounded corners. The invention is not limited, however, to this shape or edge wall configuration. Within the recess 36, there are a plurality of parallel rows of therapeutic nodules 42. The arrangement of nodules may be varied, i.e., they need not be arranged in parallel rows. The nodules 42 preferably do not extend above the upper surface 30, i.e., the nodules remain within the plane of the mat, but the height may vary as desired.

The nodules 42 are preferably of a part-spherical shape but other shapes, such as, for example, a rounded cone shape, may also be employed. In a preferred arrangement, the nodules have diameters between about ¼" and ½", and are spaced about ⅜"-1⅜" apart. These dimensions may vary, however. The nodules themselves are preferably solid and hard, particularly when formed in the part-spherical shape, with a height of about ⅛ inch. The entire chairmat 10, including the nodules 42, is made of a single plastic composition, preferably PVC, polypropylene, polycarbonate or other suitable material. Nodules 42 thus provide a means for massaging the soles of the feet while seated at a desk.

Note that while the cleats 34 appear to be substantially centered below the nodules 42, there need be no relationship between the location of the nodules 42 and the cleats 34.

Figure 2:
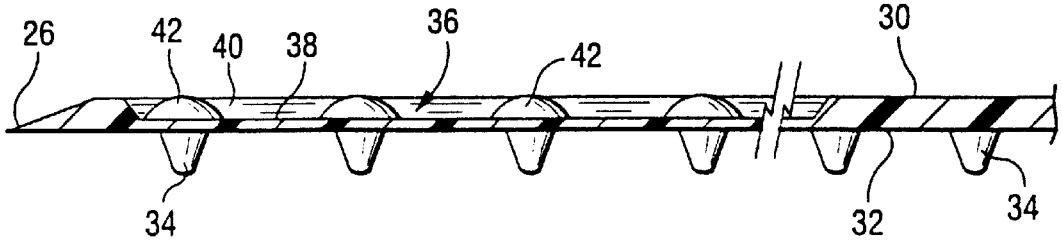
FIG. 2 is a cross section through the foot massage portion of the desk chairmat shown in FIG. 1.
Figure 3:
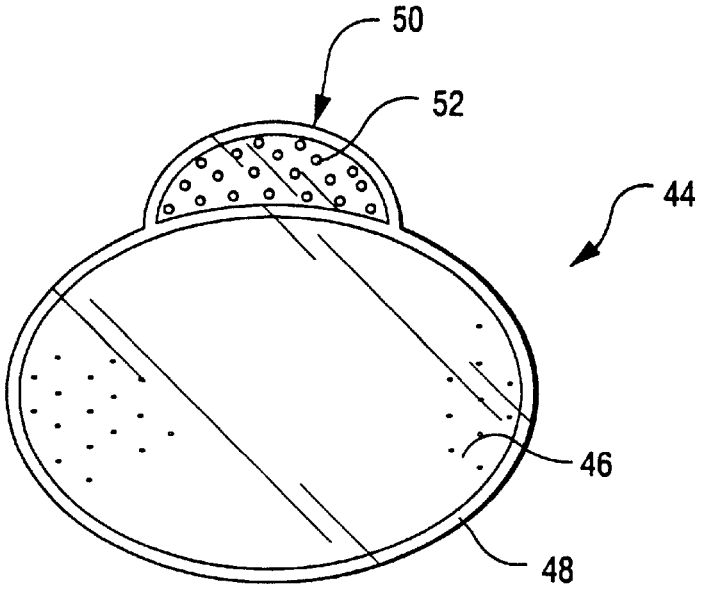
FIG. 3 is a plan view of a desk chairmat in accordance with another embodiment of the invention.

With reference now to FIG. 3, an oval desk chairmat 44 is illustrated, also comprised of a substantially planar body 46, formed with a peripheral beveled edge 48. A rounded lip extension 50 projects away from the remainder of the mat, and this lip extension includes a plurality of massage nodules 52 in a recessed area as otherwise described in connection with the embodiment illustrated in FIGS. 1 and 2.

Figure 4:
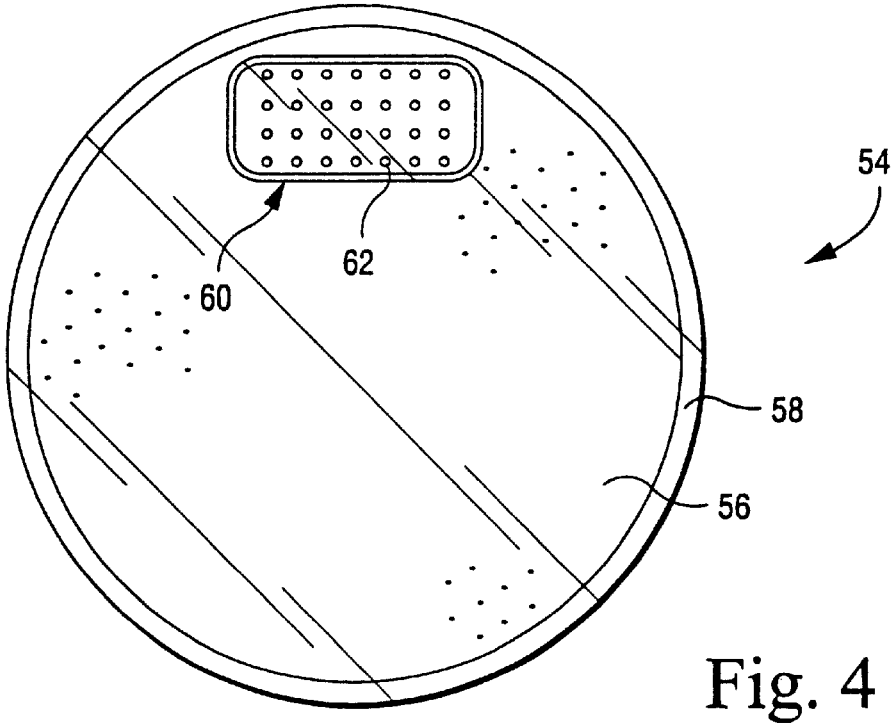
FIG. 4 is a plan view of a desk chairmat in accordance with still another embodiment of the invention.

FIG. 4 illustrates another embodiment of the invention, wherein the desk chairmat 54 is round. The substantially planar body 56 is surrounded by a peripheral beveled edge 58 and a foot massage area 60 is located within the periphery of the mat, with a plurality of foot massage nodules 62 that are similar to those described hereinabove.

It will be understood that the desk chairmat may have any of a variety of shapes and this invention relates to the incorporation of a foot massage area that may be located within the periphery of an otherwise regularly shaped mat, as shown, for example, in FIG. 4, the mat, or located in a lip extension to an otherwise regular shape, as in FIGS. 1–3.

Figure 5:
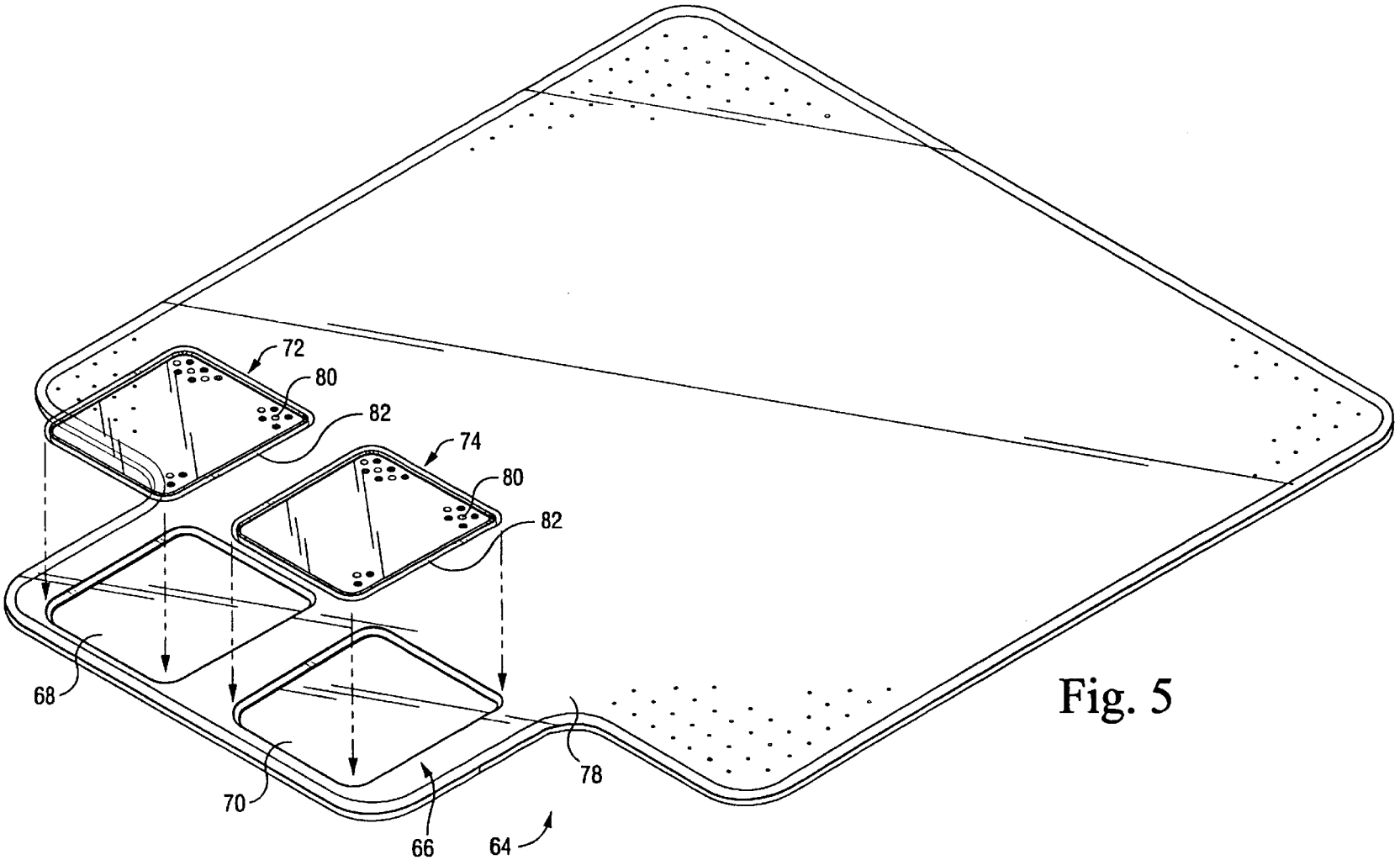
FIG. 5 is an exploded view of a desk chairmat with discrete massage mat inserts.
Figure 6:
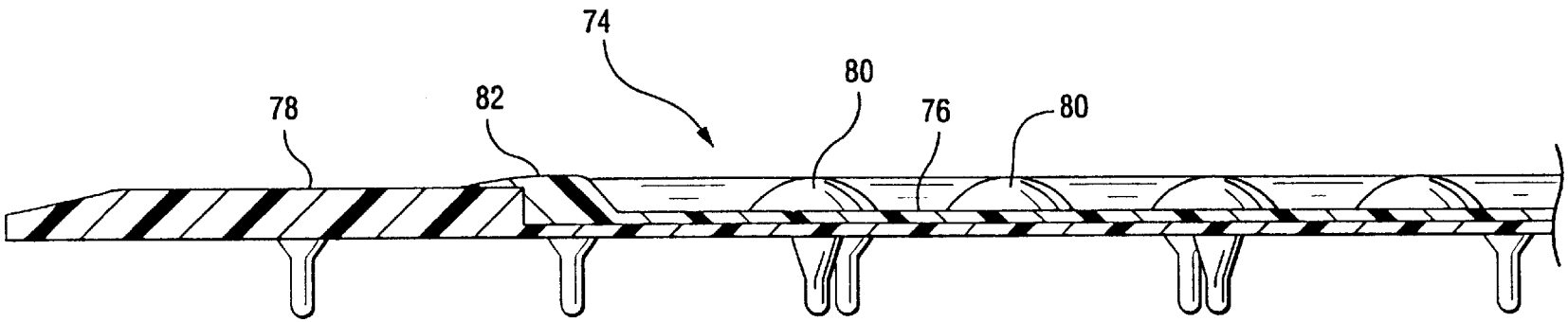
FIG. 6 is a partial section through the desk chairmat of FIG. 5.

FIGS. 5 and 6 illustrate another embodiment of the invention in which one or more discrete foot massage inserts are glued or heat sealed (or otherwise suitably secured) within one or more recesses formed in the chairmat 64 that is otherwise similar to the chairmat shown in FIG. 1. Here, the mat 64 has a lip portion 66 molded to include a pair of shallow, side-by-side recesses 68, 70. Discrete foot massage inserts 72, 74 are preferably glued or heat sealed within the recesses during manufacture of the chairmat. The individual inserts each have a base or substrate 76 with a thickness less than (and preferably less than half) the thickness of the chairmat in the recesses 68, 70. Thus, when in place, the base 76 lies below the upper surface 78 of the chairmat, and the nodules 80 will be substantially flush with the surface 78, with a thin flange 82 surrounding the recess, engaged with the top surface 78. It will be appreciated that a pair of inserts may be incorporated into the chairmat as shown, or as few or as many as are desired. It will also be appreciated that the inserts can be incorporated into a chairmat of any shape (for example, in a round or oval chairmat) and need not be limited to insertion in a forward lip portion as shown. Dimensions may also vary, but it is not desirable that the massage inserts project significantly above the upper surface of the chairmat to avoid the potential for tripping.

It should also be understood that the inserts 72, 74 may be in the form of flat panels that are molded in place on the flat upper surface of the mat, i.e., they need not be inserted into recesses as described above. Moreover, the nodules 80 may extend slightly above the upper surface of the mat, or may terminate at a level slightly below the upper surface of the mat.

Figure 7:
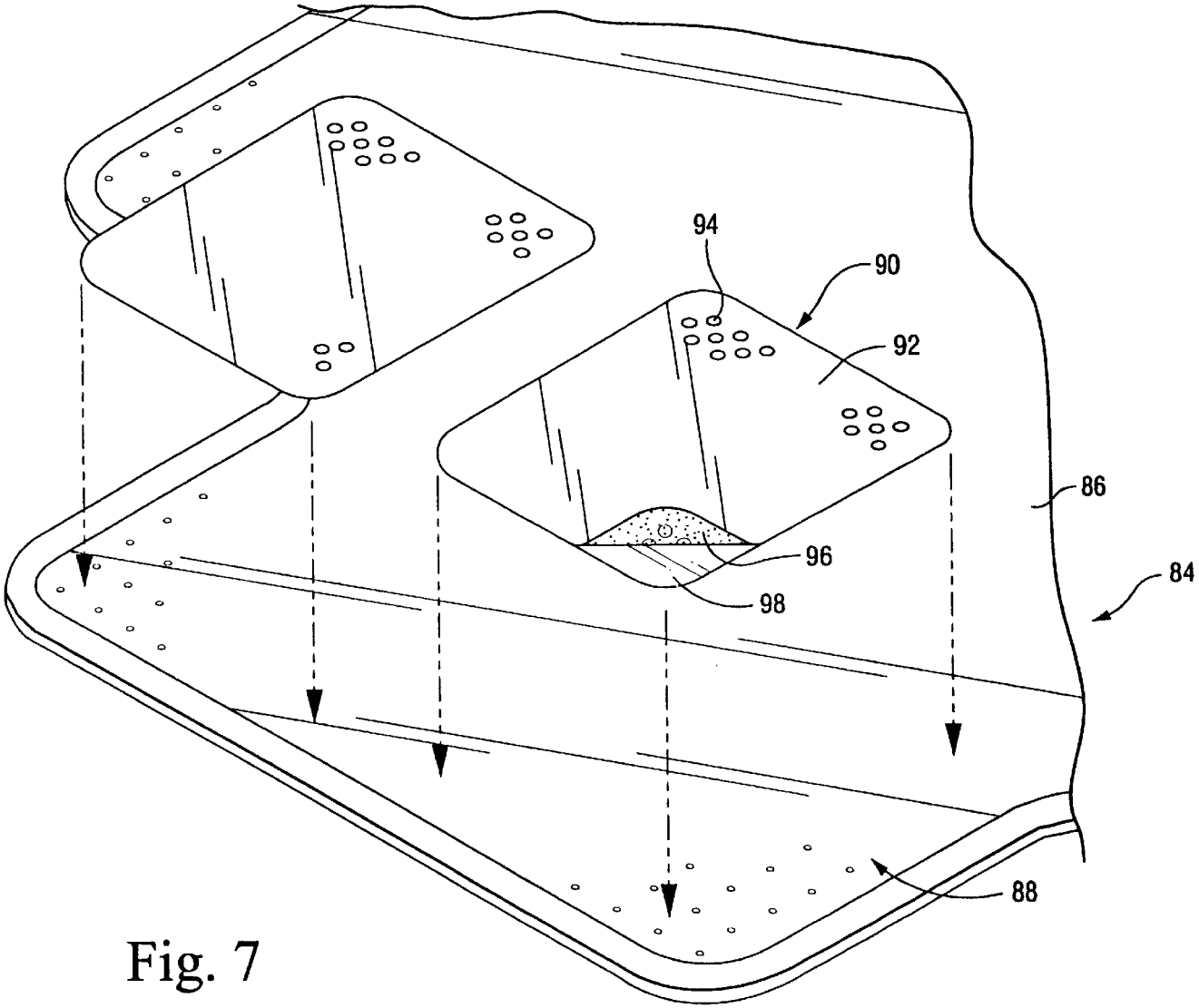
FIG. 7 is an exploded view of a desk chairmat with stick-on foot massage mats.

FIG. 7 illustrates still another embodiment of the invention that is designed to allow a customer to convert an existing chairmat to a foot massage chairmat through the application of adhesive massage mats. Specifically, a conventional chairmat 84 has a smooth upper surface 86 and includes a forward lip portion 88. A foot massage mat 90 has a relatively thin carrier or base layer 92 and a plurality of nodules 94 (similar to those previously described). The base 90 may be very thin (i.e., from about 0.010 to about 0.075 inch) to the extent of having little structural integrity since the massage mat will receive support form the chairmat itself when secured thereto. It is also desirable to keep the carrier or base layer thin to keep as low a profile as possible for the stick-on mats, again to avoid the potential for tripping. The underside of the carrier or base layer 92 is preferably coated with any suitable self-stick adhesive coating or layer 96 (preferably permanent) with a protective peel-off paper sheet 98 to be removed by the customer prior to placement of the foot massage mats onto the desired area of the chairmat. The shape and number of the stick-on massage mats, as well as the selected location where they are applied, may vary as desired. FIG. 7 shows two such stick-on mats 90 and 90', but one or more than two may be applied.

It should be understood that the mat 90 may be adhered to the surface 86 by other suitable means including hook and loop fasteners or other mechanical means or equivalents thereof.

Figure 8:
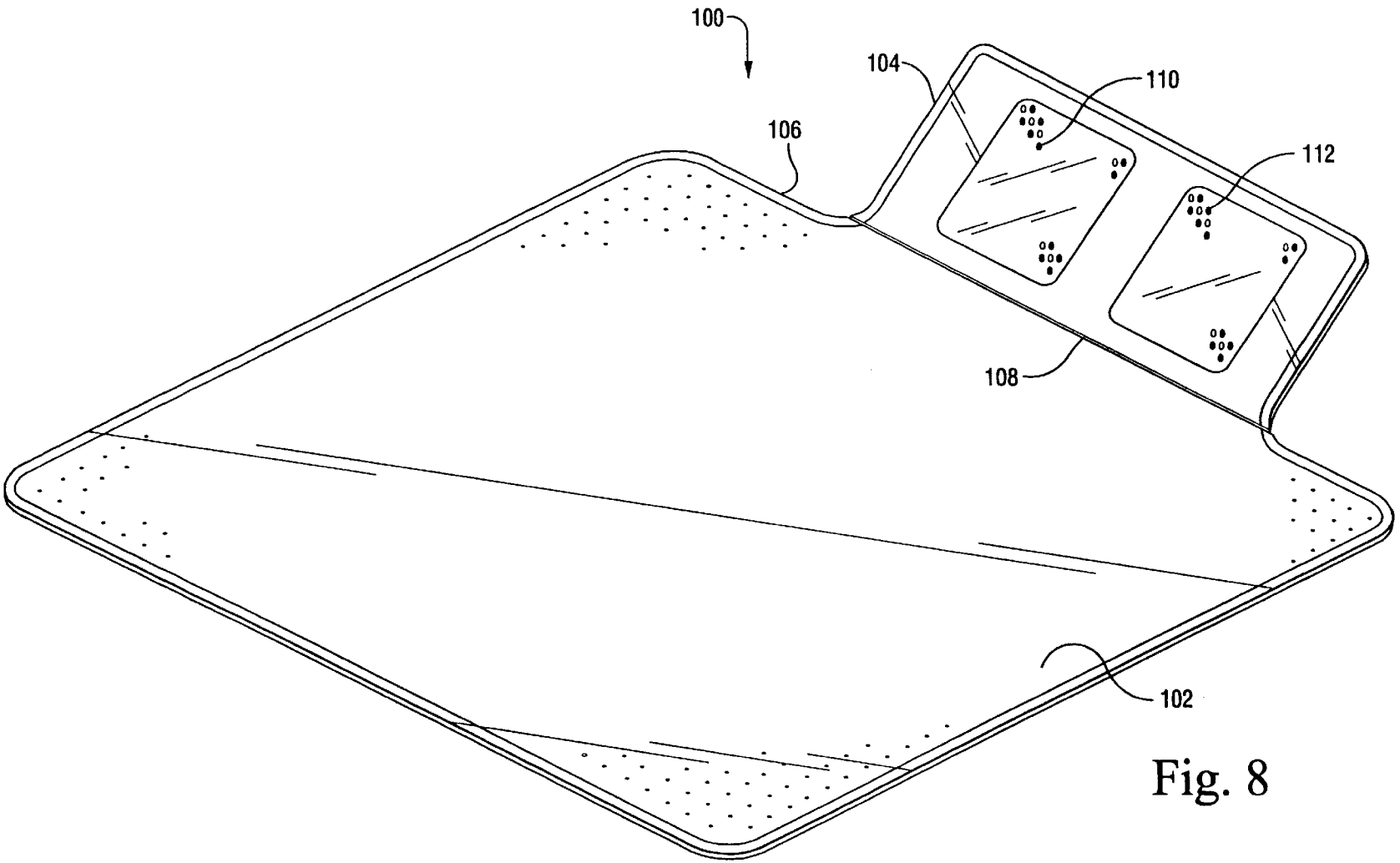
FIG. 8 is a perspective view of a desk chairmat with a hinged foot massage area in accordance with another exemplary embodiment of the invention.

With reference now to FIG. 8, a desk chairmat 100 in accordance with another exemplary embodiment of the invention includes a flat planar substrate with a smooth upper surface 102, that serves as the main chairmat portion. A forward lip portion 104 that is integrally hinged to the forward edge 106 of the main chairmat portion by means of an integral living hinge 108, enabling the forward lip portion 104 to pivot upwardly about the hinge as shown in FIG. 8. The lip portion may include one or more foot massage areas 110, 112 that may be formed in the manner described hereinabove with respect to FIG. 5, or through the addition of stick-on mats as described in connection with FIG. 7.

Figure 9:
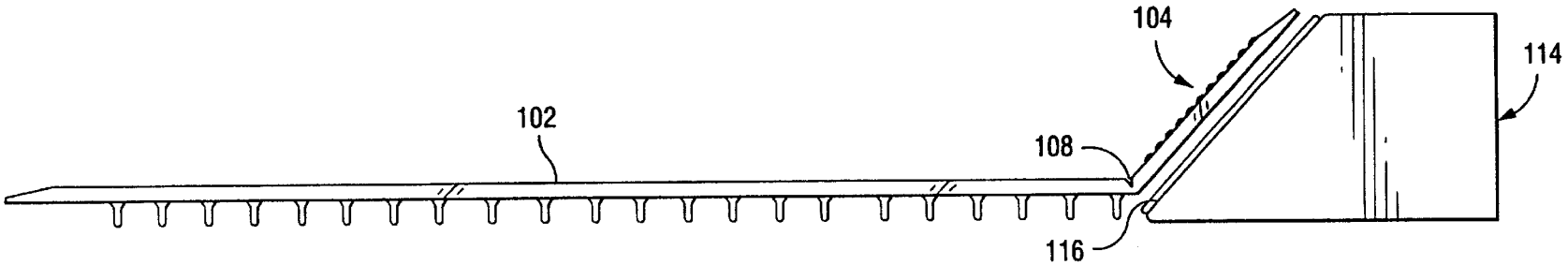
FIG. 9 is a side elevation of the desk chairmat shown in FIG. 8, with a separate heating or vibrating device located behind the hinged foot massage area.

FIG. 9 illustrates the mat of FIG. 8 but with the addition of a heating device and/or vibrating device 114 located behind, and providing support for, the hinged forward lip portion 104. Thus, the angled face 116 of the device sets the angle for the forward lip portion. The device 114 may be an electrical heater (or, for example, a heating pad), a mechanical vibrating massager, or any other support that holds the hinged portion 104 in a desired angled position. It will be appreciated that by angling the forward lip portion as desired relative to the main chairmat, a more natural foot massage position is created for the user.

Figure 10:
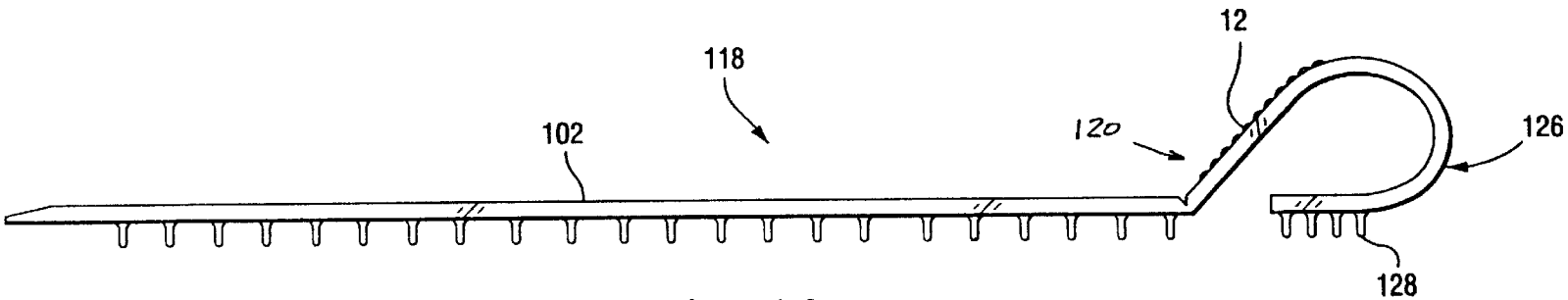
FIG. 10 is a side elevation of a desk chairmat in accordance with still another embodiment of the invention, with a hinged foot massage area and integral support.

FIG. 10 illustrates an alternative arrangement for a chairmat 118, where the hinged forward lip portion 120 with one or more foot massage areas 124 as previously described is formed with an integrally extended portion 126 that can be folded back under the forward lip portion, thus providing integral but resilient support that holds the hinged lip portion 120 in the upwardly angled position as shown in FIG. 10. Integral cleats 128 may be provided on the extended portion so that when it is folded under the forward lip portion, it will grip the carpet and maintain the lip portion in its desired upwardly hinged position.

In addition, it will be understood by those skilled in the art that the chairmat may incorporate additional features, such as an integral hinge to permit folding and easy transport of the mat; handles; and/or hang tabs as disclosed in commonly owned application Ser. No. 09/684,967 and commonly owned U.S. Pat. Nos. 6,177,165 and 6,183,833.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A desk chairmat comprising a substantially planar member having a smooth upper surface for a supporting a chair and its occupant, a lower surface, and a peripheral edge; said planar member having at least one massage area in a selected part thereof; and a discrete foot massage panel secured to said planar member within said at least one massage area, said foot massage panel having a base and a plurality of upwardly projecting foot massage nodules.

2. The desk chairmat of claim 1 wherein said nodules are of part-spherical shape.

3. The desk chairmat of claim 1 wherein said nodules are arranged in rows or in a random array.

4. The desk chairmat of claim 1 wherein said chairmat and said foot massage insert are made of PVC, polypropylene or polycarbonate material.

5. The desk chairmat of claim 1 wherein said nodules have diameters between about ¼ and ½ inch and a height of about ⅛ inch.

6. The desk chairmat of claim 5 wherein said nodules are spaced about ⅜-1⅜ inch apart.

7. The desk chairmat of claim 1 and including a plurality of cleats extending downwardly from said lower surface.

8. The desk chairmat of claim 1 wherein said selected area is in a forward extended lip portion of said planar member.

9. The desk chairmat of claim 8 wherein said forward extended lip portion is integrally hinged to said planar member.

10. The desk chairmat of claim 1 wherein tops of said nodules are substantially flush with said upper surface.

11. The desk chairmat of claim 1 wherein tops of said nodules terminate below said upper surface.

12. The desk chairmat of claim 1 wherein said nodules extend above said upper surface.

13. A desk chairmat comprising a substantially planar member having a smooth upper surface for supporting a chair and its occupant, a lower surface, and a peripheral edge; and at least one foot massage pad adhered to a selected area of said upper surface, said foot massage pad comprising a thin carrier base and a plurality of upwardly projecting nodules thereon, a lower surface of said pad having fastening means thereon for adhering said at least one foot massage pad on said upper surface.

14. The desk chairmat of claim 13 wherein said nodules are of part-spherical shape.

15. The desk chairmat of claim 13 wherein said nodules are arranged in rows or in a random array.

16. The desk chairmat of claim 13 wherein said chairmat and said foot massage pad are made of PVC, polypropylene or polycarbonate material.

17. The desk chairmat of claim 13 wherein said nodules have diameters between about ¼ and ½ inch and a height of about ⅛ inch.

18. The desk chairmat of claim 17 wherein said nodules are spaced about ⅜-1⅜ inch apart.

19. The desk chairmat of claim 13 wherein said selected area is in a forward extended lip portion of said planar member.

20. The desk chairmat of claim 19 wherein said forward extended lip portion is integrally hinged to said planar member.

21. The desk chairmat of claim 13 wherein said fastening means comprises an adhesive coating.

22. A desk chairmat comprising a substantially planar member having a smooth upper surface for supporting a chair and its occupant, a lower surface and a peripheral edge defined by four side edges and a forward lip portion extending away from one of said four side edges, the upper surface of only said forward lip portion formed with a plurality of upwardly extending foot massage nodules, and wherein said forward lip portion is connected to said one of said four side edges by an integral hinge enabling said forward lip portion to be pivoted upwardly, out of the plane of said planar member to an angled foot massage position.

23. The desk chairmat of claim 22 in combination with a support for placement behind said forward lip portion to support said forward lip portion in said angled foot massage position.

24. The desk chairmat of claim 23 wherein said support comprises a heater.

25. The desk chairmat of claim 23 wherein said support comprises a mechanical vibrating massager.

26. The desk chairmat of claim 23 including a further extension member extending beyond said forward lip portion, foldable under said forward lip portion to provide resilient support for said forward lip portion in said angled foot massage position.

* * * * *